US005546628A

United States Patent [19]

Silvera

[11] Patent Number: 5,546,628

[45] Date of Patent: Aug. 20, 1996

[54] VERSATILE PAINT CARRIER WITH SUPPORT BASKETS

[76] Inventor: Rudolph Silvera, 21-81 38th St., Apt. #4, Astoria, N.Y. 11105

[21] Appl. No.: 338,968

[22] Filed: Nov. 14, 1994

[51] Int. Cl.[6] ..... B44D 3/12

[52] U.S. Cl. ..... 15/257.06; 15/257.05; D32/53.1; 206/209; 206/209.1; 206/361

[58] Field of Search ..... 15/257.06, 260, 15/264, 257.05; D32/53, 53.1; 206/209, 209.1, 207, 229, 361, 362, 15.2, 15.3, 1.8

[56] References Cited

U.S. PATENT DOCUMENTS

| | | | |
|---|---|---|---|
| D. 350,632 | 9/1994 | Cummins | D32/53 |
| 1,373,766 | 4/1921 | Sather | 206/209 |
| 1,512,744 | 10/1924 | Calder | 15/264 |
| 1,994,525 | 3/1935 | Madda | 15/264 |
| 2,091,742 | 8/1937 | Shope | 206/362 |
| 2,705,334 | 4/1955 | Farrow | 15/264 |
| 2,832,984 | 5/1958 | Peters | 15/264 |
| 3,576,045 | 4/1971 | Stafford | 15/257.06 |
| 3,829,926 | 8/1974 | Galladay | 15/257.06 |
| 4,233,705 | 11/1980 | Lepage et al. | 15/257.06 |
| 4,266,746 | 5/1981 | Klaiber | 248/113 |
| 4,275,818 | 6/1981 | Church | 15/257.06 |
| 4,860,891 | 8/1989 | Biggio | 206/362 |
| 4,865,282 | 9/1989 | Yorkman et al. | 15/257.06 |
| 4,874,087 | 10/1989 | Mayne | 206/362.4 |
| 4,890,353 | 1/1990 | Shannon et al. | 15/257 R |
| 4,927,014 | 5/1990 | Pulichino, Jr. | 806/287.1 |
| 4,928,843 | 5/1990 | Gunderson | 15/257.06 |
| 5,038,955 | 8/1991 | Studer et al. | 15/257.06 |

FOREIGN PATENT DOCUMENTS

| | | | |
|---|---|---|---|
| 45527 | 2/1966 | Germany | 15/257.06 |
| 534349 | 10/1955 | Italy | 15/257.06 |

*Primary Examiner*—Gary K. Graham
*Attorney, Agent, or Firm*—Richard L. Miller, P.E.

[57] ABSTRACT

A versatile paint carrier comprising a box-shaped paint receptacle having an open top for holding paint therein. A first perforated basket is mounted in a vertical position to an inner surface of a side wall of the paint receptacle, so that paint can drip from bristles of paint brushes stored in the first perforated basket back into the paint receptacle. A second perforated basket is mounted in a vertical position to an inner surface of a rear wall of the paint receptacle, so that paint can drip from a roller of a paint roller stored in the second perforated basket back into the paint receptacle.

1 Claim, 1 Drawing Sheet

VERSATILE PAINT CARRIER WITH SUPPORT BASKETS

BACKGROUND OF THE INVENTION

The instant invention relates generally to paint equipment and more specifically it relates to a versatile paint carrier.

Numerous paint equipment have been provided in prior art that are adapted to hold paint brushes, paint rollers and a supply of paint which are used in painting surfaces. For example, U.S. Pat. Nos. 4,266,746 to Klaiber; 4,860,891 to Biggio; 4,874,087 to Mayne and 4,890,353 to Shannon et al. all are illustrative of such prior art. While these units may be suitable for the particular purpose to which they address, they would not be as suitable for the purposes of the present invention as heretofore described.

SUMMARY OF THE INVENTION

A primary object of the present invention is to provide a versatile paint carrier that will overcome the shortcomings of the prior art devices.

Another object is to provide a versatile paint carrier that will support paint brushes and roller in perforated baskets within a receptacle holding a quantity of paint, so that any paint in the paint brushes and roller can drip back into the receptacle.

An additional object is to provide a versatile paint carrier in which a roller excess paint remover device can be attached to a top edge of the receptacle, to allow any paint in the roller to be extracted therefrom and go back into the receptacle that can be transported by handles to different locations.

A further object is to provide a versatile paint carrier that is simple and easy to use.

A still further object is to provide a versatile paint carrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
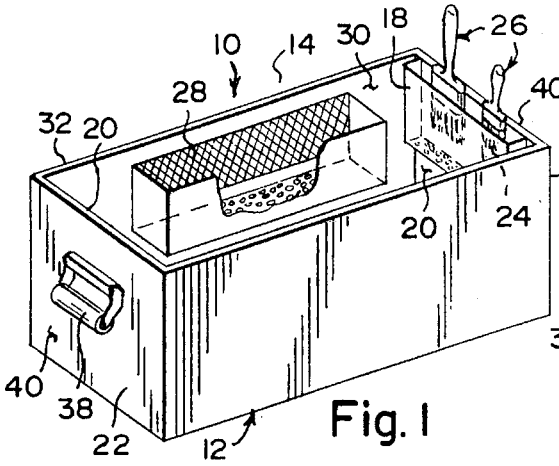
FIG. 1 is a diagrammatic perspective view with parts broken away, of a first embodiment of the instant invention.
Figure 2:
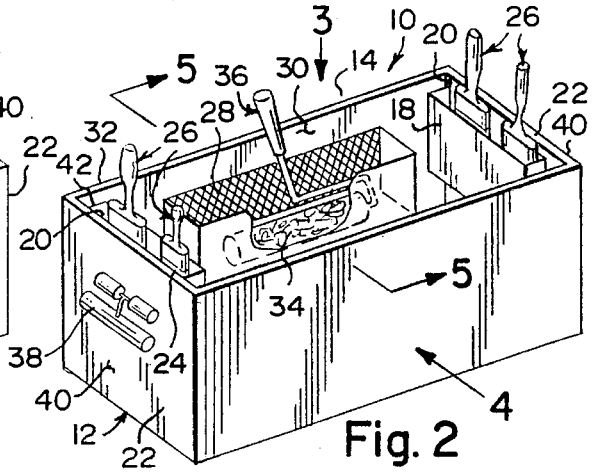
FIG. 2 is a diagrammatic perspective view with parts broken away of a second embodiment of the instant invention.
Figure 3:
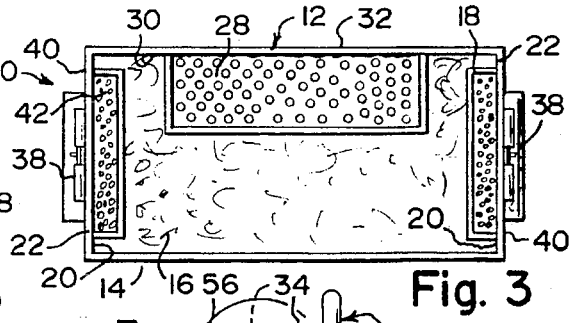
FIG. 3 is a top plan view taken in the direction of arrow 3 in FIG. 2.
Figure 4:
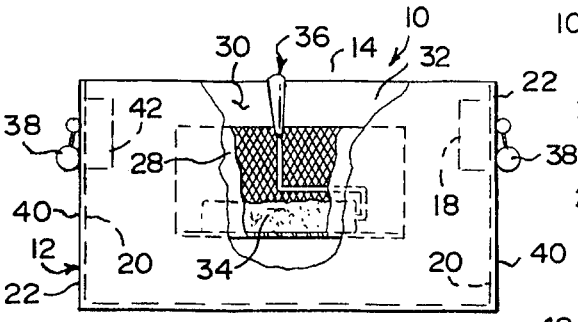
FIG. 4 is a front elevational view with parts broken away taken in the direction of arrow 4 in FIG. 2.
Figure 5:
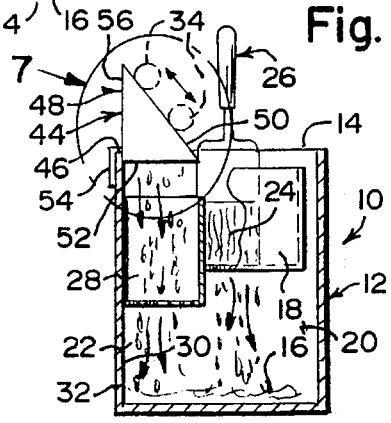
FIG. 5 is a cross sectional view taken on line 5—5 in FIG. 2, with the roller excess paint remover device installed thereon.
Figure 6:
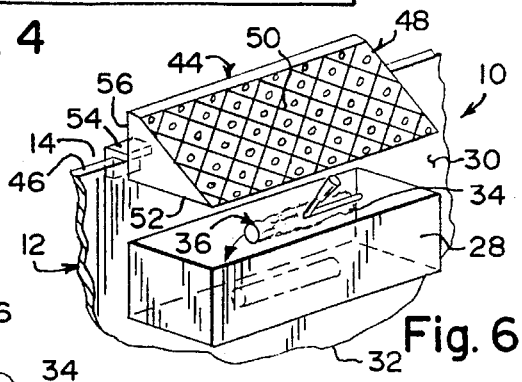
FIG. 6 is an enlarged diagrammatic perspective view with parts broken away illustrating how a paint roller may be stored in the instant invention.
Figure 7:
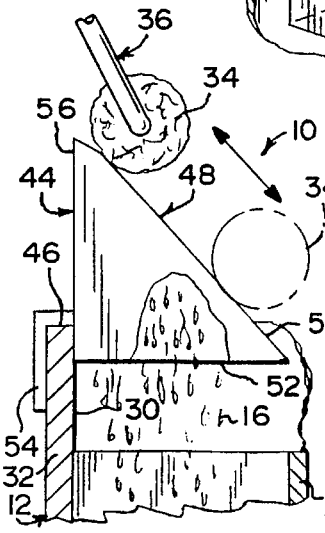
FIG. 7 is an enlarged diagrammatic view with parts broken away of the area indicated by arrow 7 in FIG. 5.
Figure 8:
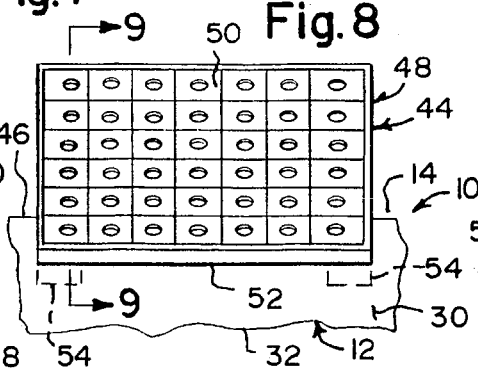
FIG. 8 is an enlarged diagrammatic front elevational view of an alternate embodiment of the roller excess paint remover device.
Figure 9:
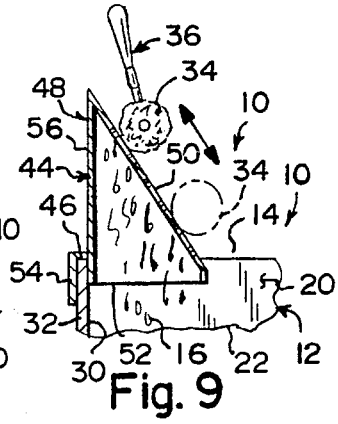
FIG. 9 is a cross sectional view taken on line 9—9 of FIG. 8.

Turning now descriptively to the drawings, in which similar reference characters denote similar elements throughout the several views, FIGS. 1 through 9 illustrate a versatile paint carrier 10, comprising a box-shaped paint receptacle 12 having an open top 14 for holding paint 16 therein. A first perforated basket 18 is mounted in a vertical position to an inner surface 20 of a side wall 22 of the paint receptacle 12, so that paint 16 can drip from bristles 24 of paint brushes 26 when stored in the first perforated basket 18, back into the paint receptacle 12. A second perforated basket 28 is mounted in a vertical position to an inner surface 30 of a rear wall 32 of the paint receptacle 12, so that plaint 16 can drip from a roller 34 of a paint roller 36 stored in the second perforated basket 28 back into the paint receptacle 12.

A pair of handles 38 are each affixed to an opposite outer surface 40 of one side wall 22 of the paint receptacle 12, so that a person can grasp the handles 38 and transport the carrier 10 from one location to another location. A third perforated basket 42 is mounted in a vertical position to an inner surface 20 of a side wall 22 of the paint receptacle 12 opposite from the first perforated basket 18, so that paint 16 can drip from bristles 24 of additional paint brushes 26 stored in the third perforated basket 42 back into the paint receptacle 12. To facilitate cleaning thereof, a roller excess paint removed device 44 is attached in a removable manner to a top rear edge 46 of the paint receptacle 12, to allow any paint 16 in the paint roller 36 to be extracted therefrom and run back into the paint receptacle 12.

The paint remover device 44 includes a triangular shaped housing 48 having a perforated downwardly angled front wall 50 and an open bottom 52. A pair of inverted L-shaped brackets 54 are attached in spaced apart relationships to a lower portion of a vertical rear wall 56 of the triangular shaped housing. The brackets 54 can hook onto the top rear edge 46 of the paint receptacle 12, with the perforated downwardly angled front wall 50 extending over the paint receptacle 12, to allow paint 16 from the paint roller 36 to drip down into the paint receptacle 12.

OPERATION OF THE INVENTION

To use the versatile paint carrier 10 a person simply stores the paint brushes 25 in the perforated baskets 18 and 42. The paint 16 will drip from the bristles 24 back into the paint receptacle 12. The paint roller 36 is stored in the perforated basket 28, to allow paint 16 from the roller 34 to drip back into the paint receptacle 12. The paint roller 36 can also be rolled on the angled front wall 50 of the paint remover device 44, to remove excess paint 16 therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A versatile paint carrier comprising:

a) a box-shaped paint receptacle having an open top for holding paint therein;

b) a first perforated basket mounted in a vertical position to an inner surface of a side wall of said paint receptacle, so that paint can drip from bristles of paint brushes stored in said first perforated basket back into said paint receptacle; and c) a second perforated basket mounted in a vertical position to an inner surface of a rear wall of said paint receptacle, so that paint can drip from a roller of a paint roller stored in said second perforated basket back into said paint receptacle;

further including a pair of handles, each affixed to an opposite outer surface of one side wall of said paint receptacle, so that a person can grasp said handles and transport said carrier from one location to another location, further including a third perforated basket mounted in a vertical position to an inner surface of a side wall of said paint receptacle opposite from said first perforated basket, so that paint can drip from bristles of additional paint brushes inserted into said third perforated basket back into said paint receptacle, further including a roller excess paint remover device which to facilitate cleaning thereof, is removable attached to a top rear edge of said paint receptacle, to allow any paint in the paint roller to be extracted therefrom and go back into said paint receptacle, wherein said paint remover device includes:

i) a triangular shaped housing having a perforated downwardly angled front wall and an open bottom; and ii) a pair of inverted L-shaped brackets attached in spaced apart relationships to a lower portion of a vertical rear wall of said triangular shaped housing, so that said brackets can hook onto the top rear edge of said paint receptacle, with the perforated downwardly angled front wall extending over said paint receptacle, to allow paint from the paint roller to drip down into said paint receptacle.

* * * * *